US010547114B2

(12) United States Patent
Wang et al.

(10) Patent No.: US 10,547,114 B2
(45) Date of Patent: Jan. 28, 2020

(54) SLOT ANTENNA AND MOBILE TERMINAL

(71) Applicant: HUAWEI TECHNOLOGIES CO., LTD., Shenzhen, Guangdong (CN)

(72) Inventors: Hanyang Wang, Reading (GB); Lijun Ying, Shanghai (CN); Xuefei Zhang, Shenzhen (CN); Chien-Ming Lee, Shanghai (CN); Dong Yu, Shanghai (CN); Liang Xue, Shanghai (CN); Lei Wang, Shanghai (CN); Chih-Hua Chang, Taipei (TW)

(73) Assignee: Huawei Technologies Co., Ltd., Shenzhen (CN)

( * ) Notice: Subject to any disclaimer, the term of this patent is extended or adjusted under 35 U.S.C. 154(b) by 108 days.

(21) Appl. No.: 15/566,518

(22) PCT Filed: Apr. 16, 2015

(86) PCT No.: PCT/CN2015/076786

§ 371 (c)(1),
(2) Date: Oct. 13, 2017

(87) PCT Pub. No.: WO2016/165113

PCT Pub. Date: Oct. 20, 2016

(65) Prior Publication Data

US 2018/0138598 A1 May 17, 2018

(51) Int. Cl.
*H01Q 13/10* (2006.01)
*H01Q 1/24* (2006.01)
(Continued)

(52) U.S. Cl.
CPC ..... *H01Q 13/103* (2013.01); *H01Q 1/242* (2013.01); *H01Q 13/085* (2013.01);
(Continued)

(58) Field of Classification Search
CPC ..... H01Q 1/243; H01Q 5/328; H01Q 13/103; H01Q 1/48
See application file for complete search history.

(56) References Cited

U.S. PATENT DOCUMENTS 6,618,020 B2 9/2003 Wang et al.
8,120,542 B2 2/2012 Shoji
(Continued)

FOREIGN PATENT DOCUMENTS

CN 103227364 7/2013
CN 103390796 11/2013
CN 104064865 9/2014

OTHER PUBLICATIONS

Extended European Search Report dated Jan. 4, 2018 in corresponding European Patent Application No. 15888818.0, 10 pp.
(Continued)

*Primary Examiner* — Ricardo I Magallanes
(74) *Attorney, Agent, or Firm* — Slater Masil, LLP

(57) ABSTRACT

Embodiments of the present invention relate to the field of antenna technologies, and provide a slot antenna and a mobile terminal, to generate different resonance frequencies, so as to cover required bands. The slot antenna includes a system circuit board, a grounding conductor, a radiator, and a first adjustable unit. The system circuit board is connected to the grounding conductor to form an electric conductor, and the radiator is opposite to the electric conductor to form a slot. A feeding end is disposed on the system circuit board, the feeding end is electrically connected to the radiator, one end of the first adjustable unit is connected to the system circuit board, the other end of the first adjustable unit is connected to the radiator, and the first adjustable unit is configured to adjust a resonance frequency of the slot antenna.

15 Claims, 12 Drawing Sheets

(51) Int. Cl.
*H01Q 13/08* (2006.01)
*H01Q 13/12* (2006.01)
*H01Q 13/26* (2006.01)

(52) U.S. Cl.
CPC ..... *H01Q 13/106* (2013.01); *H01Q 13/12* (2013.01); *H01Q 13/26* (2013.01)

(56) References Cited

U.S. PATENT DOCUMENTS

2002/0027528 A1* 3/2002 Okabe ..... H01Q 1/243 343/702
2011/0148722 A1 6/2011 Bellows
2012/0299785 A1* 11/2012 Bevelacqua ..... H01Q 9/42 343/702
2013/0194143 A1* 8/2013 Bungo ..... H01Q 21/28 343/725
2014/0266922 A1* 9/2014 Jin ..... H01Q 21/28 343/702
2014/0266941 A1 9/2014 Vazquez et al.
2015/0084817 A1* 3/2015 Yong ..... H01Q 1/243 343/702
2016/0211570 A1 7/2016 Jin et al.

OTHER PUBLICATIONS

Office Action, dated Sep. 5, 2018, in Chinese Application No. 201580021774.5 (8 pp.).
International Search Report dated Jan. 22, 2016 in corresponding International Patent Application No. PCT/CN2015/076786.
Zhe-Jun Jin et al., *Compact Wideband Open-End Slot Antenna With Inherent Matching*, IEEE Antennas and Wireless Propagation Letters, vol. 13, 2014, pp. 1385-1388.
International Search Report, dated Jan. 22, 2016, in International Application No. PCT/CN2015/075786 (4 pp.).

* cited by examiner

SLOT ANTENNA AND MOBILE TERMINAL

CROSS-REFERENCE TO RELATED APPLICATIONS

This application is a national stage of International Application No. PCT/CN2015/076786, filed on Apr. 16, 2015, which is hereby incorporated by reference in its entirety.

TECHNICAL FIELD

Embodiments of the present invention relate to the field of antenna technologies, and in particular, to a slot antenna and a mobile terminal.

BACKGROUND

With increasing popularity of mobile terminals and requirements of users for thin mobile terminals, the mobile terminals are designed to be more compact, and therefore space occupied by other components including antennas in the mobile terminals is smaller. Meanwhile, to enable the mobile terminals to be more durable, more metal materials are used in the mobile terminals, but the metal materials may affect energy efficiency of the antennas. Therefore, design of the antennas in the mobile terminals becomes more difficult. Because a slot antenna occupies small space and is less sensitive to surrounding metal materials, the slot antenna has become a hot option of an antenna in a mobile terminal and also has become a research focus of people.

In the prior art, after a slot antenna is set, a generated resonance frequency can cover only a particular band. With hybrid application of 2G, 3G, and 4G networks, the slot antenna is required to be capable of covering currently required bands. Therefore, how to enable the slot antenna to cover the currently required bands has become a problem to be resolved urgently.

SUMMARY

Embodiments of the present invention provide a slot antenna and a mobile terminal, to generate different resonance frequencies, so as to cover required bands.

To achieve the foregoing objective, the following technical solutions are used in the embodiments of the present invention:

According to a first aspect, an embodiment of the present invention provides a slot antenna, including a system circuit board, a grounding conductor, a radiator, and a first adjustable unit, where the system circuit board is connected to the grounding conductor to form an electric conductor, and the radiator is opposite to the electric conductor to form a slot; a feeding end is disposed on the system circuit board, the feeding end is electrically connected to the radiator, one end of the first adjustable unit is connected to the system circuit board, the other end of the first adjustable unit is connected to the radiator, and the first adjustable unit is configured to adjust a resonance frequency of the slot antenna.

In a first possible implementation manner of the first aspect, the slot antenna further includes a matching circuit, where one end of the matching circuit is connected to the feeding end of the system circuit board, and the other end of the matching circuit is connected to the radiator.

With reference to the first aspect or the first possible implementation manner of the first aspect, in a second possible implementation manner of the first aspect, the slot antenna further includes a grounding unit, and the system circuit board is electrically connected to the grounding conductor by using the grounding unit, to form the electric conductor.

With reference to the first aspect or the first two possible implementation manners of the first aspect, in a third possible implementation manner of the first aspect, the first adjustable unit includes a switch apparatus and at least two reactance elements, the at least two reactance elements are connected in parallel to form a parallel circuit, a first end of the switch apparatus is connected to the system circuit board, a control end of the switch apparatus is configured to receive a switching signal, a second end of the switch apparatus is configured to connect to one reactance element in the parallel circuit according to the switching signal, and the other end of the parallel circuit is connected to the radiator.

With reference to the third possible implementation manner of the first aspect, in a fourth possible implementation manner of the first aspect, the first adjustable unit further includes a variable capacitor, where one end of the variable capacitor is connected to the system circuit board, and the other end of the variable capacitor is connected to the first end of the switch apparatus.

With reference to the first aspect or the first four possible implementation manners of the first aspect, in a fifth possible implementation manner of the first aspect, the slot antenna further includes a second adjustable unit, where one end of the second adjustable unit is electrically connected to the system circuit board, the other end of the second adjustable unit is electrically connected to the radiator, and the second adjustable unit is disposed at a side that is opposite to the first adjustable unit and that is bounded by the feeding end.

With reference to the fifth possible implementation manner of the first aspect, in a sixth possible implementation manner of the first aspect, the second adjustable unit includes a switch apparatus and at least two reactance elements, the at least two reactance elements are connected in parallel to form a parallel circuit, one end of the switch apparatus is connected to the system circuit board, a control end of the switch apparatus is configured to receive a switching signal, a second end of the switch apparatus is configured to connect to one reactance element in the parallel circuit according to the switching signal, and the other end of the parallel circuit is connected to the radiator.

With reference to the sixth possible implementation manner of the first aspect, in a seventh possible implementation manner of the first aspect, the second adjustable unit further includes a variable capacitor, where one end of the variable capacitor is connected to the system circuit board, and the other end of the variable capacitor is connected to the first end of the switch apparatus.

In an eighth possible implementation manner of the first aspect, the slot formed by the radiator and the electric conductor that are opposite is of a flat shape.

In a ninth possible implementation manner of the first aspect, the slot formed by the radiator and the electric conductor that are opposite is of a bent shape.

With reference to the third or sixth possible implementation manner of the first aspect, in a tenth possible implementation manner of the first aspect, the reactance elements are inductive reactance elements or capacitive reactance elements.

According to a second aspect, an embodiment of the present invention further provides a mobile terminal, including: a radio frequency processing unit, a baseband processing unit, and the slot antenna according to the first aspect or any possible implementation manner of the first aspect, where the radio frequency processing unit is electrically connected to the feeding end on the system circuit board; and the slot antenna is configured to: transmit a received radio signal to the radio frequency processing unit, or convert a transmitted signal of the radio frequency processing unit into an electromagnetic wave and send the electromagnetic wave; the radio frequency processing unit is configured to: perform frequency selection, amplification, and down-conversion processing on the radio signal received by the slot antenna, convert the radio signal into an intermediate frequency signal or a baseband signal, and send the intermediate frequency signal or baseband signal to the baseband processing unit, or configured to: perform up-conversion and amplification on a baseband signal or an intermediate frequency signal sent by the baseband processing unit and send a radio signal by using the slot antenna; and the baseband processing unit processes the received intermediate frequency signal or baseband signal.

The embodiments of the present invention provide the slot antenna and the mobile terminal. The slot antenna includes a system circuit board, a grounding conductor, a radiator, and a first adjustable unit. The system circuit board is connected to the grounding conductor to form an electric conductor, and the radiator is opposite to the electric conductor to form a slot. A feeding end is disposed on the system circuit board, the feeding end is electrically connected to the radiator, one end of the first adjustable unit is connected to the system circuit board, the other end of the first adjustable unit is connected to the radiator, and the first adjustable unit is configured to adjust a resonance frequency of the slot antenna. In the slot antenna provided in the embodiments of the present invention, the resonance frequency of the slot antenna is adjusted by using the first adjustable unit, so that the slot antenna can generate different slot-type resonance frequencies, to cover required bands.

BRIEF DESCRIPTION OF DRAWINGS

To describe the technical solutions in the embodiments of the present invention more clearly, the following briefly describes the accompanying drawings required for describing the embodiments or the prior art. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

Figure 1:
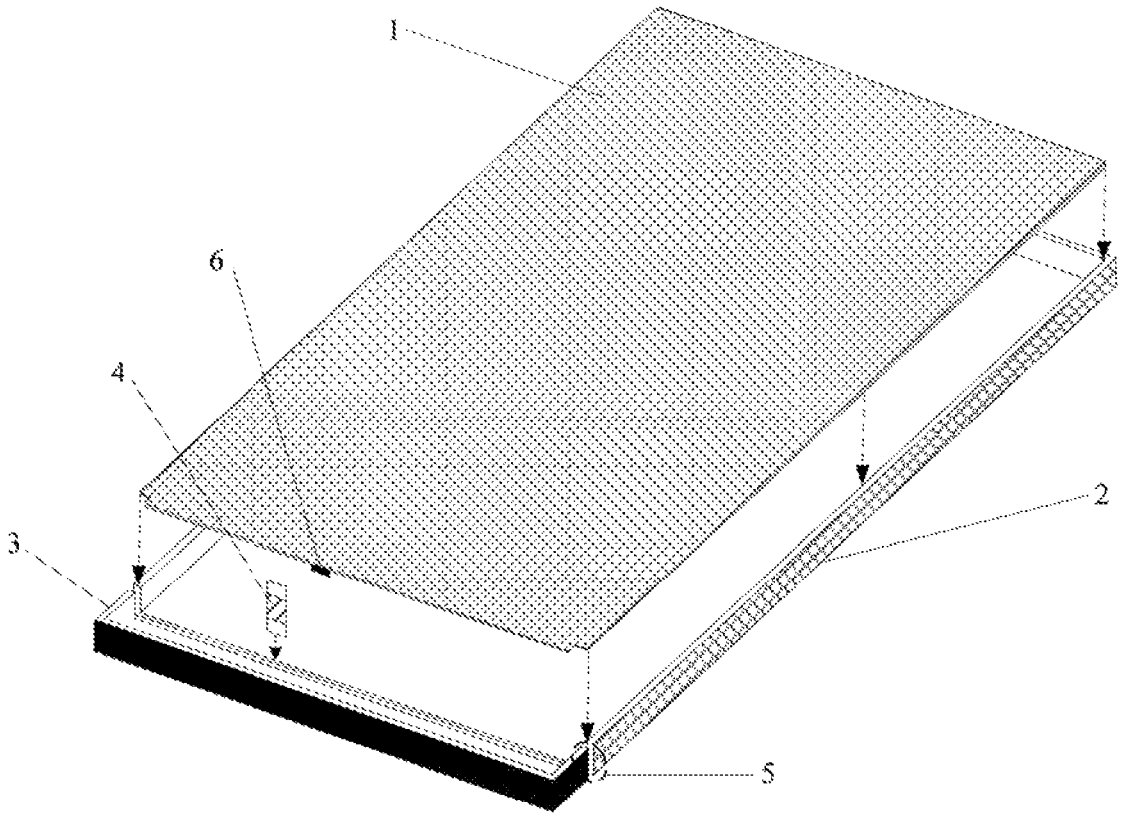
FIG. 1 is a schematic structural diagram of a slot antenna according to an embodiment of the present invention.
Figure 2:
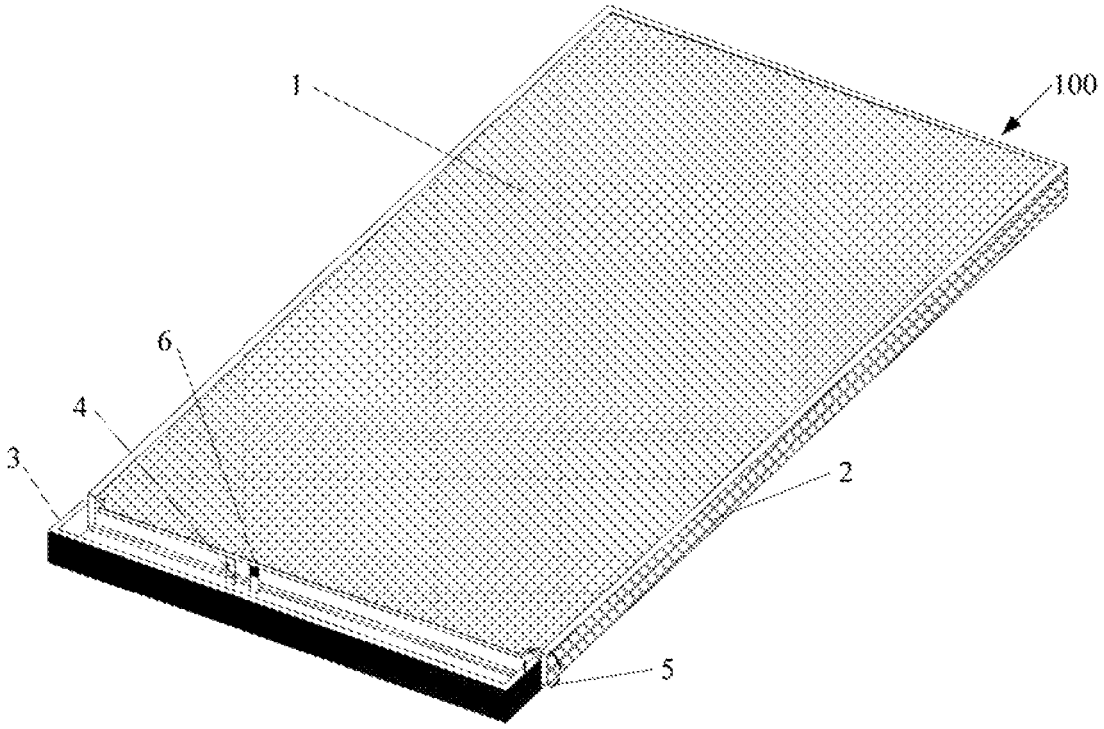
FIG. 2 is a front view of the slot antenna shown in FIG. 1.

The following clearly and completely describes the technical solutions in the embodiments of the present invention with reference to the accompanying drawings in the embodiments of the present invention. Apparently, the described embodiments are merely some but not all of the embodiments of the present invention. All other embodiments obtained by a person of ordinary skill in the art based on the embodiments of the present invention without creative efforts shall fall within the protection scope of the present invention.

Embodiment 1

This embodiment of the present invention provides a slot antenna. With reference to FIG. 1 to FIG. 4, the slot antenna includes: a system circuit board 1 (a part filled with dots in FIG. 1), a grounding conductor 2 (a part filled with double slashes in FIG. 1), a radiator 3 (a part filled with black in FIG. 1), and a first adjustable unit 4 (a part filled with single slashes in FIG. 1). The system circuit board 1 is connected to the grounding conductor 2 to form an electric conductor 100. The radiator 3 is opposite to the electric conductor 100 to form a slot 5. A feeding end 6 is disposed on the system circuit board 1, and the feeding end 6 is electrically connected to the radiator 3. One end of the first adjustable unit 4 is connected to the system circuit board 1, and the other end of the first adjustable unit 4 is connected to the radiator 3. The first adjustable unit 4 is configured to adjust a resonance frequency of the slot antenna.

In the slot antenna provided in this embodiment of the present invention, the resonance frequency of the slot antenna is adjusted by using the first adjustable unit 4, so that the slot antenna can generate different resonance frequencies, which are slot-type resonances frequencies, to cover required bands.

Figure 5:
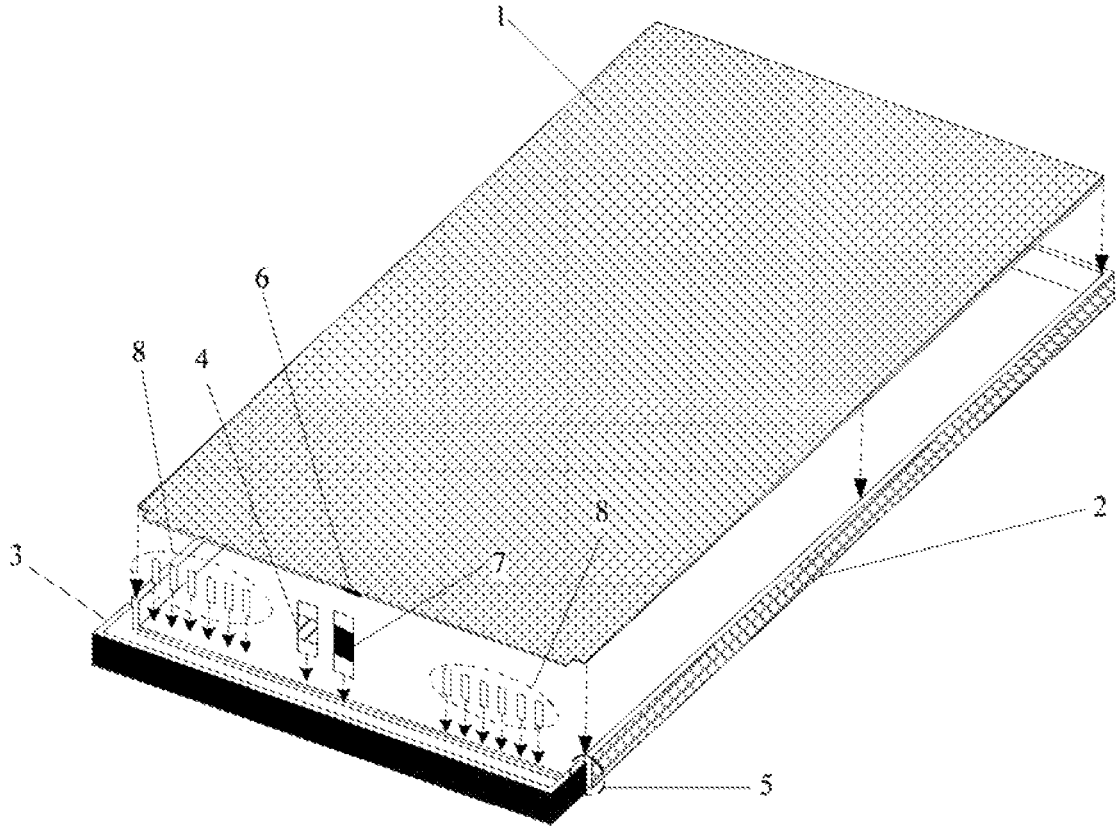
FIG. 5 is a schematic structural diagram of another slot antenna according to an embodiment of the present invention.

Optionally, as shown in FIG. 5, the slot antenna further includes a matching circuit 7. One end of the matching circuit 7 is electrically connected to the feeding end 6 of the system circuit board 1, and the other end of the matching circuit 7 is electrically connected to the radiator 3. That is, the feeding end 6 of the system circuit board 1 is electrically connected to the radiator 3 by using the matching circuit 7. The matching circuit 7 performs feed-in, mainly to adjust impedance matching of the slot antenna, so that the slot antenna can stimulate a sufficient bandwidth, to cover the required bands.

Figure 3:
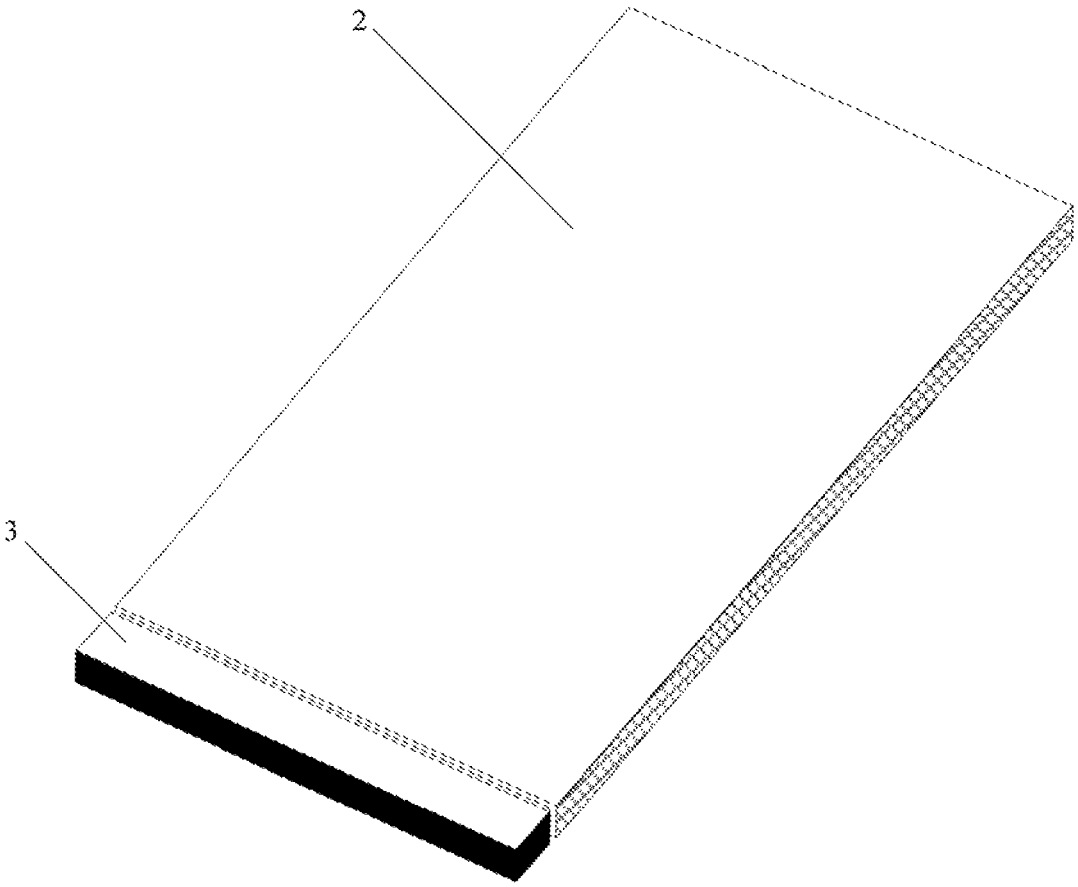
FIG. 3 is a rear view of the slot antenna shown in FIG. 1.
Figure 4:
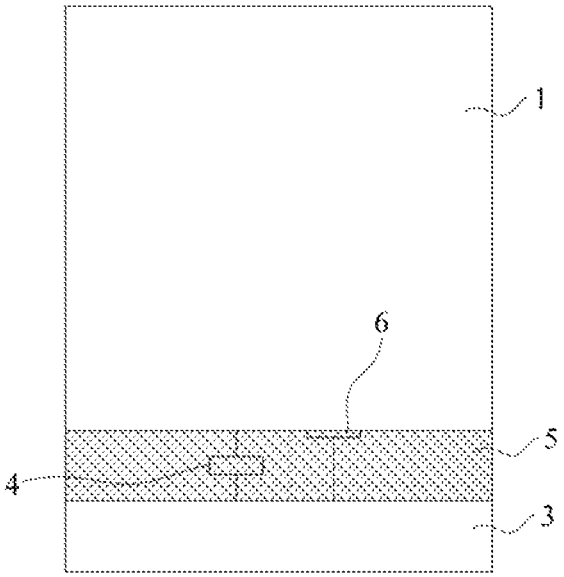
FIG. 4 is a simplified diagram of the slot antenna shown in FIG. 1.

In addition, as shown in FIG. 5, the system circuit board 1 may be electrically connected to the grounding conductor 2 by using a grounding unit 8 shown in FIG. 3, to form the foregoing electric conductor 100. There may be multiple grounding units 8.

Figure 6:
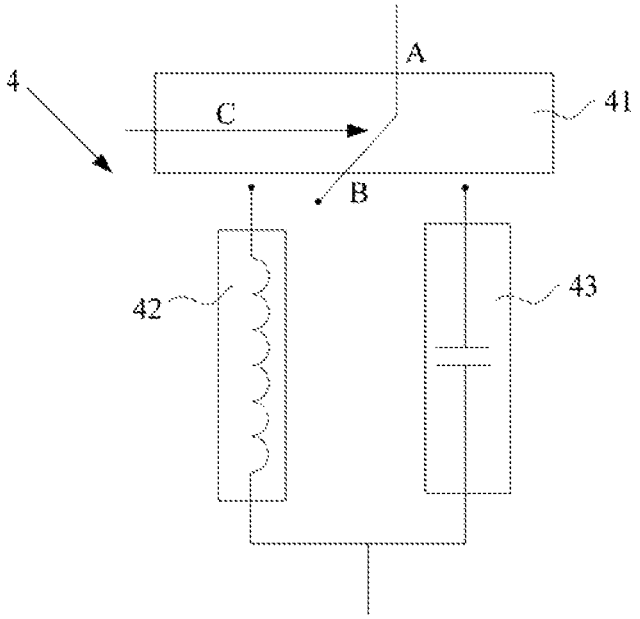
FIG. 6 is a first schematic architectural diagram of a first adjustable unit according to an embodiment of the present invention.

To describe the first adjustable unit 4 more clearly, as shown in FIG. 6, the first adjustable unit 4 includes a switch apparatus 41 and at least two reactance elements 42 and 43. The at least two reactance elements 42 and 43 are connected in parallel to form a parallel circuit. A first end A of the switch apparatus 41 is connected to the system circuit board 1, a control end C of the switch apparatus 41 is configured to receive a switching signal, and a second end B of the switch apparatus 41 is configured to connect to one reactance element in the parallel circuit according to the switching signal. The other end of the parallel circuit is connected to the radiator 3.

In this way, the switch apparatus 41 enables, according to the switching signal received by the control end C, the second end B of the switch apparatus 41 to connect to a particular reactance element in the parallel circuit, so that the slot antenna generates a resonance frequency corresponding to the connected reactance element. When reactances of the reactance elements in the parallel circuit are different, the slot antenna generates different resonance frequencies. In addition, because the first adjustable unit is configured to adjust the resonance frequency of the slot antenna, when the switch apparatus 41 is connected to different reactance elements, resonances may be generated at different frequencies.

The reactance elements in the first adjustable unit 4 may be capacitive reactance elements or inductive reactance elements. Therefore, FIG. 6 uses an example in which the first adjustable unit 4 includes two reactance elements, the reactance element 42 is an inductive reactance element, and the reactance element 43 is a capacitive reactance element. A first adjustable unit including another quantity of reactance elements or another type (capacitive or inductive) of reactance element also falls with the protection scope of the present invention. The quantity and the type of the reactance elements may be determined according to a band needing to be covered.

Figure 7:
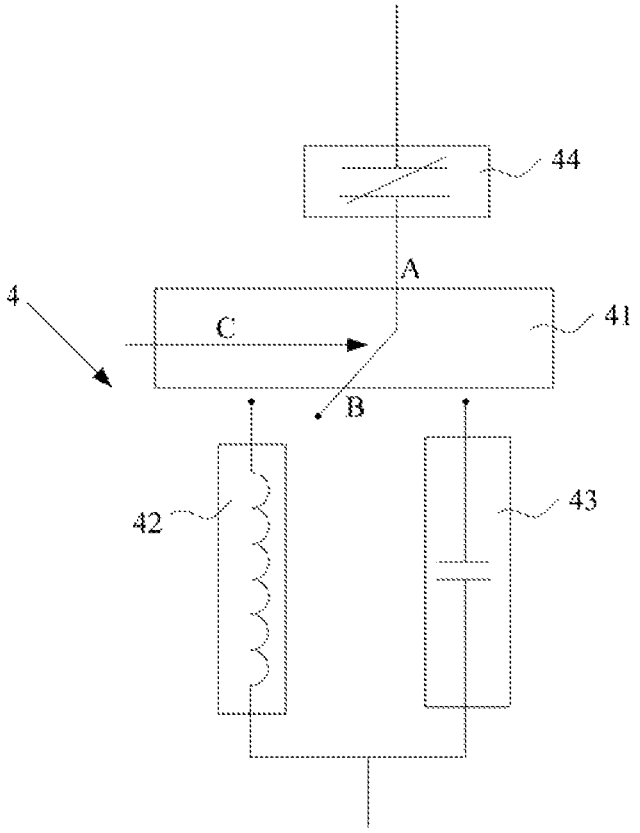
FIG. 7 is a second schematic architectural diagram of a first adjustable unit according to an embodiment of the present invention.

Further, as shown in FIG. 7, the first adjustable unit 4 may further include a variable capacitor 44. One end of the variable capacitor 44 is connected to the system circuit board 1, and the other end of the variable capacitor 44 is connected to the first end A of the switch apparatus 41. Because a capacitance of the variable capacitor 44 may be adjusted, a resonance frequency generated by the slot antenna may be adjusted adaptively to an expected band by adjusting the capacitance of the variable capacitor 44.

Figure 8:
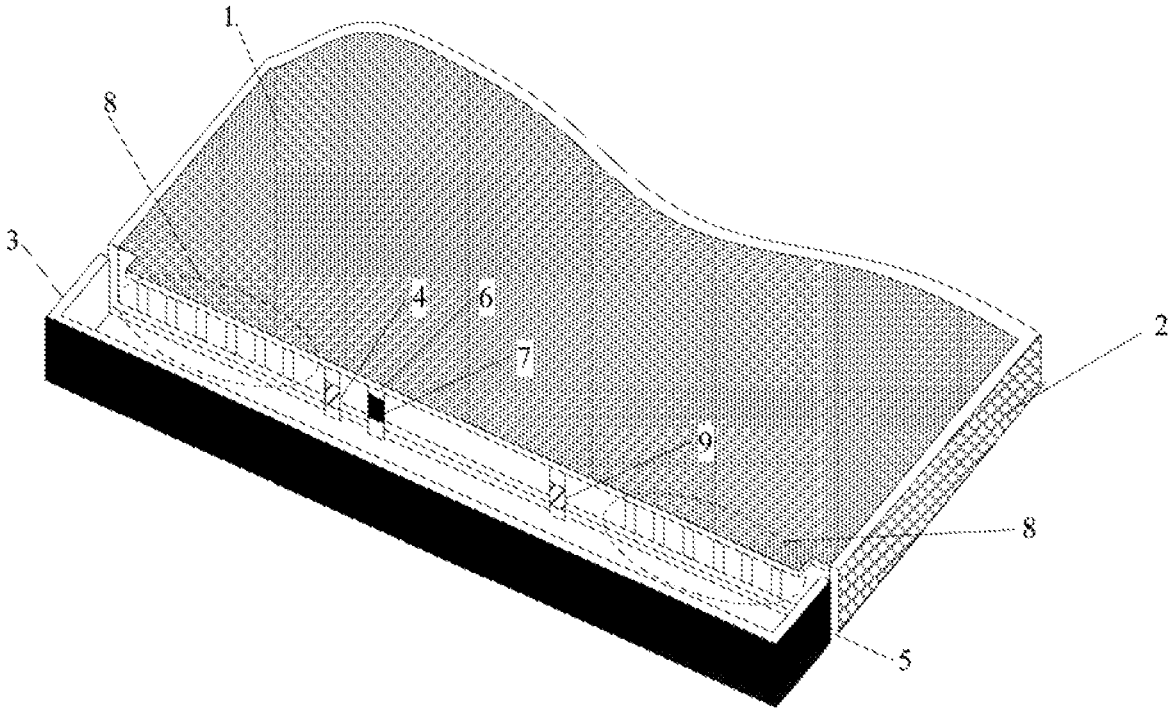
FIG. 8 is a schematic structural diagram of another slot antenna according to an embodiment of the present invention.

Further, to enable the slot antenna to satisfy a requirement of covering more frequencies, as shown in FIG. 8, the slot antenna further includes a second adjustable unit 9. One end of the second adjustable unit 9 is electrically connected to the system circuit board 1, and the other end of the second adjustable unit 9 is electrically connected to the radiator 3. The second adjustable unit 9 is disposed at a side that is opposite to the first adjustable unit 4 and that is bounded by the feeding end 6.

The second adjustable unit 9 may use an architecture the same as that of the first adjustable unit 4. Therefore, for the structure of the second adjustable unit 9, refer to descriptions of the first adjustable unit 4 in FIG. 6 and FIG. 7, and details are not described herein again. In addition, reactance elements in the second adjustable unit 9 may be capacitive reactance elements, or inductive reactance elements, and different reactance elements may be selected according to actual statuses.

Figure 9:
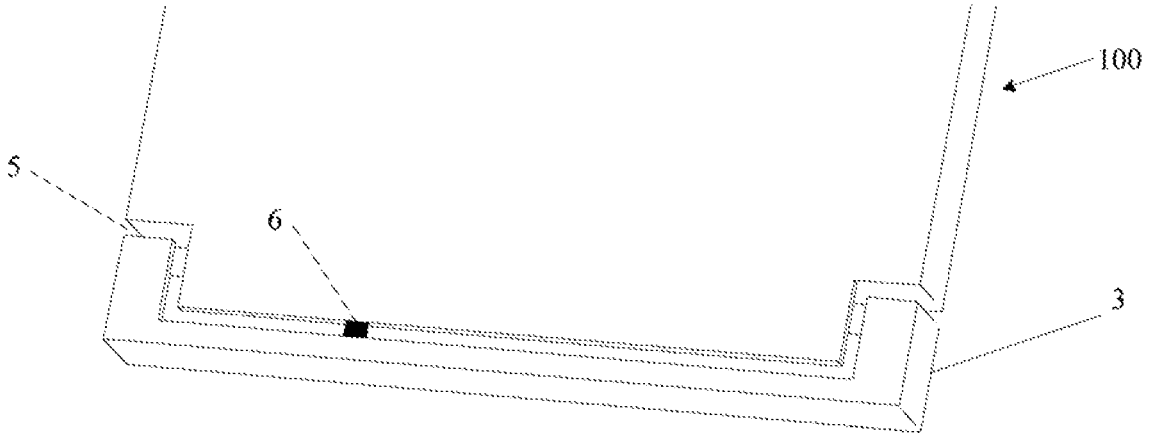
FIG. 9 is a first schematic diagram of a shape of a slot of a slot antenna according to an embodiment of the present invention.
Figure 10:
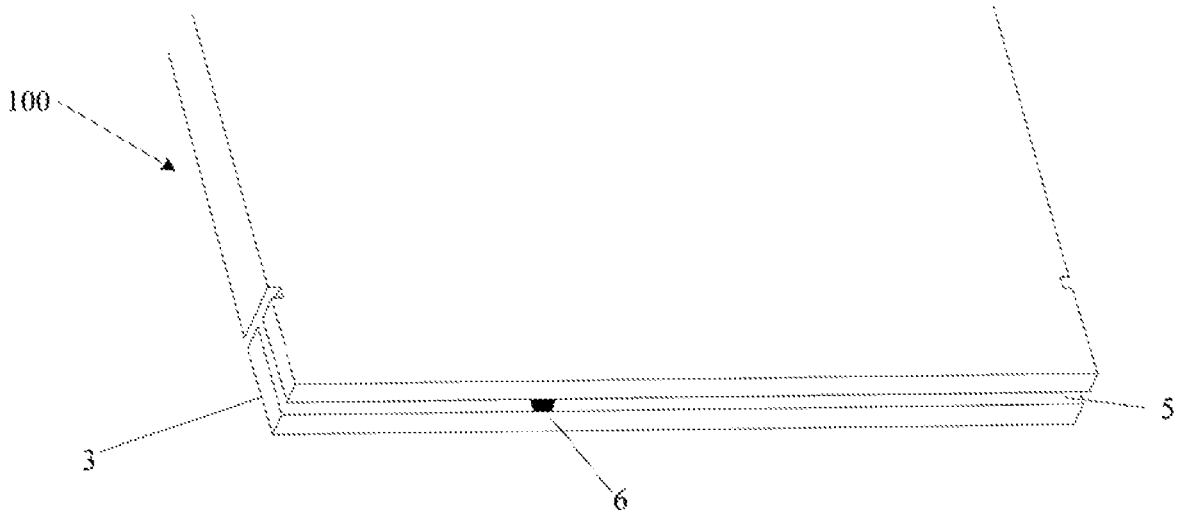
FIG. 10 is a second schematic diagram of a shape of a slot of a slot antenna according to an embodiment of the present invention.
Figure 11:
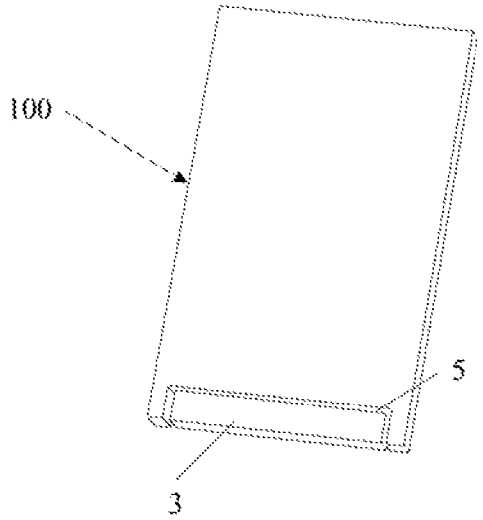
FIG. 11 is a third schematic diagram of a shape of a slot of a slot antenna according to an embodiment of the present invention.

Further, the slot 5 formed by the radiator 3 and the electric conductor 100 that are opposite may be of a flat shape or a bent shape. FIG. 1 to FIG. 5 and FIG. 8 are schematic diagrams when the slot 5 formed by the radiator 3 and the electric conductor 100 is of a linear shape. FIG. 9 to FIG. 11 are schematic diagrams when the slot 5 formed by the radiator 3 and the electric conductor 100 is of a bent shape. It should be noted that this embodiment of the present invention is described by using only an example in which the slot is of the linear shape or bent shape, and a slot of another shape also falls within the protection scope of the embodiments of the present invention.

This embodiment of the present invention provides the slot antenna. The slot antenna includes a system circuit board, a grounding conductor, a radiator, and a first adjustable unit. The system circuit board is connected to the grounding conductor to form an electric conductor, and the radiator is opposite to the electric conductor to form a slot. A feeding end is disposed on the system circuit board, the feeding end is electrically connected to the radiator, one end of the first adjustable unit is connected to the system circuit board, the other end of the first adjustable unit is connected to the radiator, and the first adjustable unit is configured to adjust a resonance frequency of the slot antenna. In the slot antenna provided in this embodiment of the present invention, the resonance frequency of the slot antenna is adjusted by using the first adjustable unit, so that the slot antenna can generate different slot-type resonance frequencies, to cover required bands.

Embodiment 2

Figure 12:
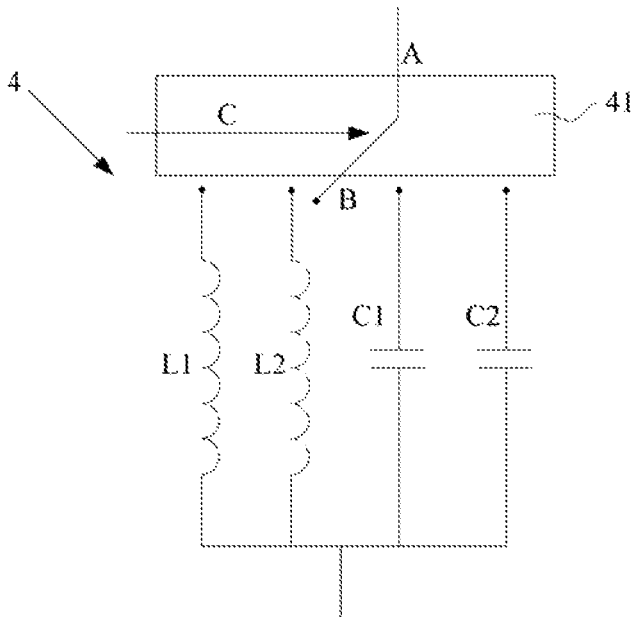
FIG. 12 is a schematic architectural diagram of a first adjustable unit used in a slot antenna according to Embodiment 2 of the present invention.
Figure 13:
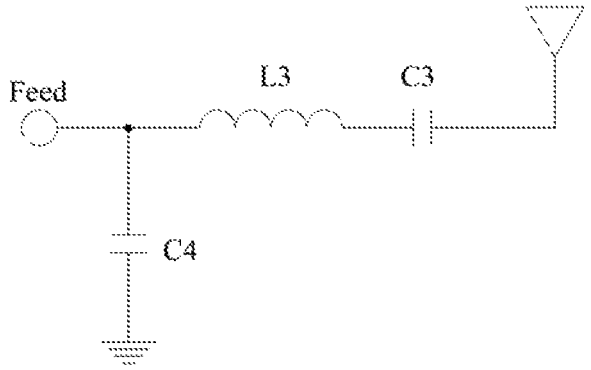
FIG. 13 is a schematic architectural diagram of a matching circuit used in the slot antenna according to Embodiment 2 of the present invention.

For the slot antenna described in Embodiment 1, this embodiment of the present invention provides a specific slot antenna used in a mobile phone. A schematic structural diagram of the slot antenna is shown in FIG. 5. A part filled with double slashes of a grounding conductor 2 in FIG. 5 is considered as a long side of the mobile phone, and a part filled with black on a front side of a radiator in FIG. 5 is considered as a short side of the mobile phone. A feeding end 6 is set in a range of approximately 7 mm from a middle line of the short side of the mobile phone. A first adjustable unit 4 includes two inductors (L1=40 nH and L2=80 nH) and two capacitors (C1=0.5 pF and C2=0.9 pF), and a specific connection manner is shown in FIG. 12. A matching circuit 7 includes one inductor (L3=1.2 nH) and two capacitors (C3=1.3 pF and C4=2.5 pF), and a specific connection manner is shown in FIG. 13. One end of the inductor L3 is connected to the feeding end 6 (Feed), the other end is connected to one end of the capacitor C3, the other end of the capacitor C3 is connected to the radiator 3 (represented by an inverted triangle in FIG. 13), one end of the capacitor C4 is connected to the one end of the inductor L3, and the other end of the capacitor C4 is grounded. Description is made by using an example in which a width of the radiator 3 is 6.5 mm, and a width of a slot 5 is 1.5 mm.

Figure 14:
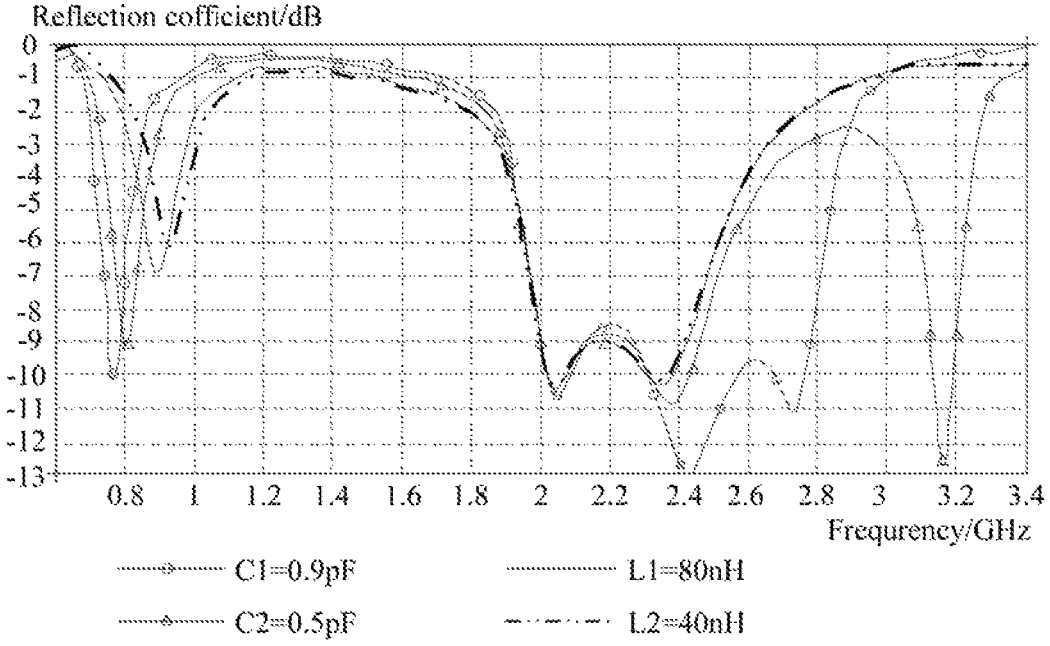
FIG. 14 is a curve chart of simulated reflection coefficients obtained when the first adjustable unit is used in the slot antenna and the slot antenna corresponds to different inductance values or capacitance values according to Embodiment 2 of the present invention.

As shown in FIG. 14, FIG. 14 is a curve chart of simulated reflection coefficients obtained when the slot antenna provided in this embodiment of the present invention corresponds to different inductance values or capacitance values. The horizontal axis represents frequency (Frequency, Freq for short), whose unit is Giga hertz (GHz), and the vertical axis represents reflection coefficient (reflection coefficient), whose unit is decibel (dB). A line plus circle is used to represent a curve chart of simulated reflection coefficients of the slot antenna when a switch apparatus is connected to the capacitor C1, a line plus triangle is used to represent a curve chart of simulated reflection coefficients of the slot antenna when the switch apparatus is connected to the capacitor C1, a line is used to represent a curve chart of simulated reflection coefficients of the slot antenna when the switch apparatus is connected to the inductor L1, and a dash-dot line is used to represent a curve chart of simulated reflection coefficients of the slot antenna when the switch apparatus is connected to the inductor L2. As can be seen from FIG. 14, when the switch apparatus is connected to different inductors or capacitors, the slot antenna generates four slot-type resonances. In addition, because in this embodiment of the present invention, the first adjustable unit is disposed in an area with a low frequency and a large electric field, when the switch apparatus is connected to different inductors or capacitors, resonance frequencies generated by the slot antenna in a low-frequency area are different, and resonance frequencies in a high-frequency area are basically the same. Therefore, the switch apparatus is connected to different inductors or capacitors, so that the slot antenna can generate different resonance frequencies, to cover required frequencies.

Figure 15:
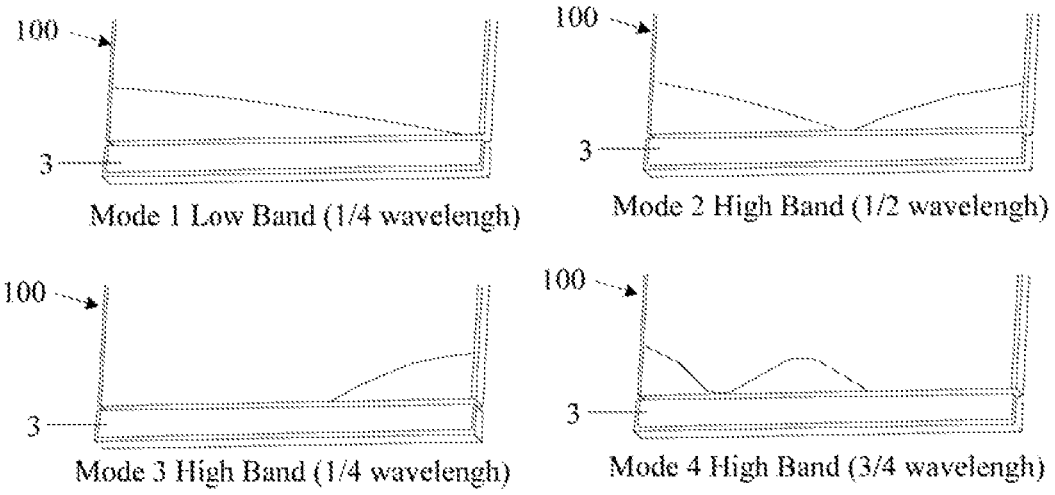
FIG. 15 is a diagram of strength distribution of a simulated electric field when the first adjustable unit is used in the slot antenna according to Embodiment 2 of the present invention.

Four obvious resonances in FIG. 15 represent that four resonance modes are generated. Therefore, the modes in FIG. 14 are analyzed by means of a diagram of strength distribution of a simulated electric field shown in FIG. 15. Based on a transmission line theory, the following conclusions may be obtained: (a). Mode 1 in a low frequency is ¼ wavelength resonance (Mode 1 Low Band (¼ wavelength)); (b). mode 2 in a high frequency is ½ wavelength resonance (Mode 2 High Band (½ wavelength)); (c). mode 3 in a high frequency is ¼ wavelength resonance (Mode 3 High Band (½ wavelength)); and (d). mode 4 in a high frequency is ¾ wavelength resonance (Mode 4 High Band (¾ wavelength)). As shown in FIG. 14 and FIG. 15, four slot-type resonances stimulated by the slot antenna provided in this embodiment of the present invention may cover commonly required LTE bands by means of the first adjustable unit.

Figure 16:
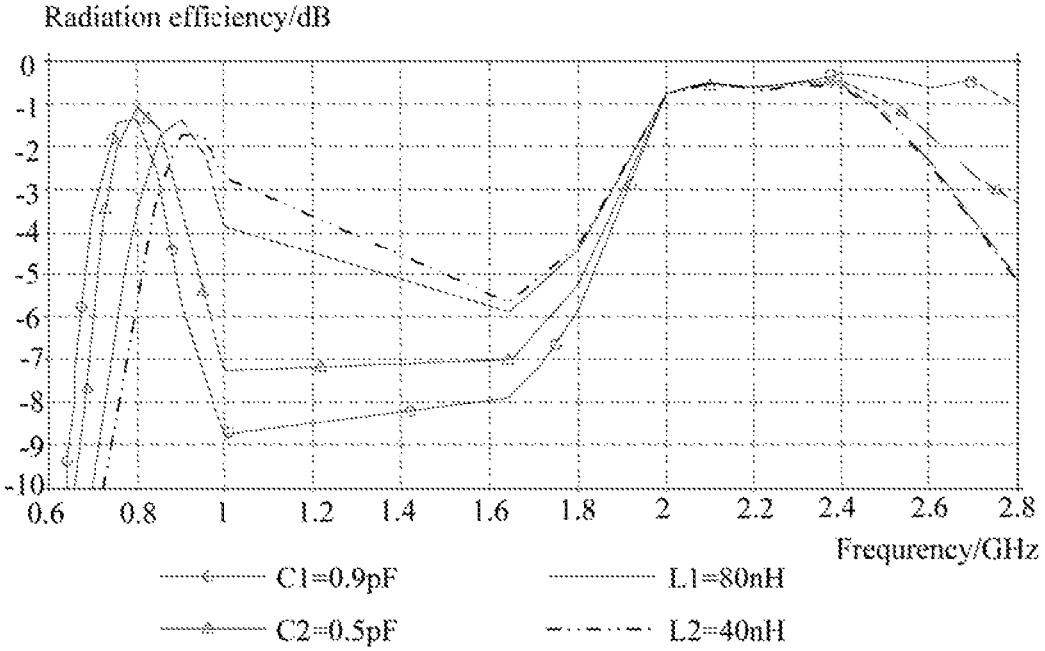
FIG. 16 is a chart of antenna radiation efficiency obtained through simulation when the first adjustable unit is used in the slot antenna and the slot antenna corresponds to different inductance values or capacitance values according to Embodiment 2 of the present invention.

As shown in FIG. 16, FIG. 16 is a chart of antenna radiation efficiency obtained through simulation when the slot antenna provided in this embodiment of the present invention corresponds to different inductance values or capacitance values. The horizontal axis represents frequency, whose unit is Giga hertz (GHz), and the vertical axis represents antenna efficiency (Radiation Efficiency), whose unit is decibel (dB). A line plus circle is used to represent a curve chart of simulated antenna efficiency of the slot antenna when the switch apparatus is connected to the capacitor C1, a line plus triangle is used to represent a curve chart of simulated antenna efficiency of the slot antenna when the switch apparatus is connected to the capacitor C1, a line is used to represent a curve chart of simulated antenna efficiency of the slot antenna when the switch apparatus is connected to the inductor L1, and a dash-dot line is used to represent a curve chart of simulated antenna efficiency of the slot antenna when the switch apparatus is connected to the inductor L2. As can be seen from FIG. 16, in the slot antenna provided in this embodiment of the present invention, the switch apparatus is connected to different inductors or capacitors in the first adjustable unit, so that the obtained antenna frequencies can satisfy requirements of actual applications. Certainly, the antenna efficiency of the slot antenna in the high frequency can also satisfy the actual requirements.

Figure 17:
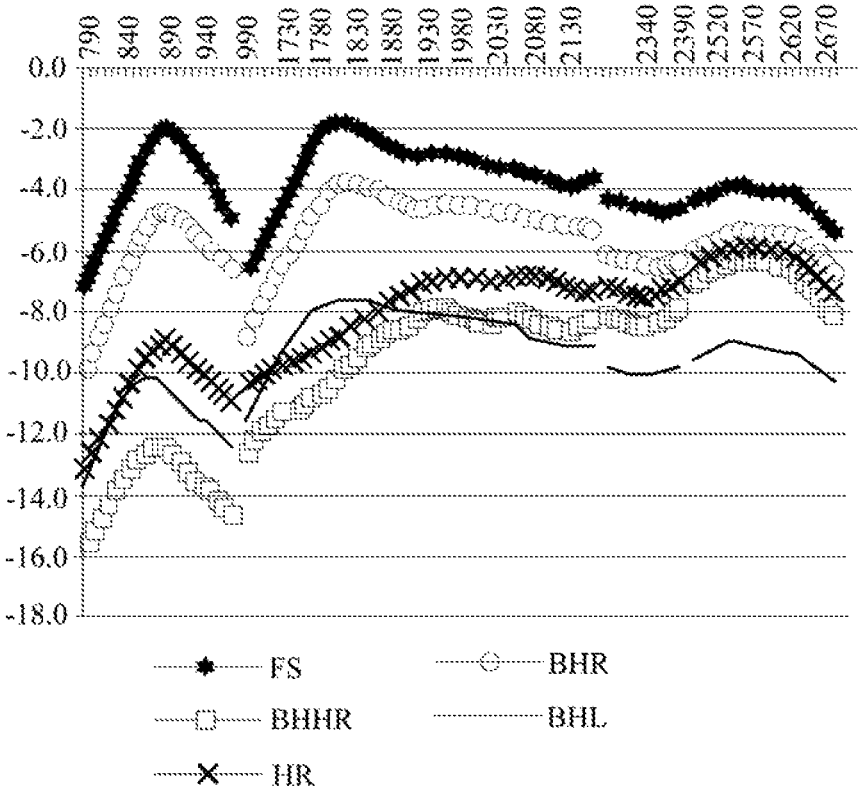
FIG. 17 is a chart of antenna radiation efficiency in different test models when the slot antenna switches to L2 according to Embodiment 2 of the present invention.

When setting of the first adjustable unit switches to L2=80 nH, for different test models, the radiation efficiency of the slot antenna is tested, and test results are shown in FIG. 17. The horizontal axis represents frequency, whose unit is Giga hertz (MHz), and the vertical axis represents antenna efficiency, whose unit is decibel (dB). A line plus hexagon represents a chart of radiation efficiency of the slot antenna in a free space (Free space, FS for short) test state, a line plus square represents a chart of radiation efficiency of the slot antenna in a beside head and hand right side (Beside Head and Hand Right Side, BHHR for short) test state, a line plus cross represents a chart of radiation efficiency of the slot antenna in a hand right (Hand Right, HR for short) test state, a line plus circle represents a chart of radiation efficiency of the slot antenna in a beside head right side (Beside Head Right Side, BHR for short) test state, and a line represents a chart of radiation efficiency of the slot antenna in a beside head left side (Beside Head Left Side, BHL for short) test state. As can be seen from FIG. 17, when the first adjustable unit switches to L2=80 nH, in different test models, the slot antenna has fine antenna radiation efficiency.

Figure 18:
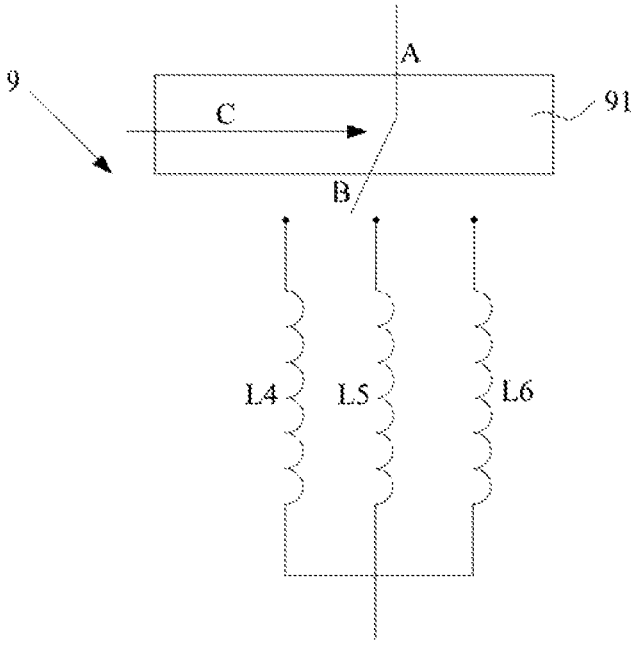
FIG. 18 is a schematic architectural diagram of a second adjustable unit used in the slot antenna according to Embodiment 2 of the present invention.

Further, on the basis that the slot antenna includes the first adjustable unit 4 shown in FIG. 12 and the matching circuit 7 shown in FIG. 13, the slot antenna further includes a second adjustable unit 9. In this case, for a schematic structural diagram of the slot antenna, refer to FIG. 8. The second adjustable unit includes a switch apparatus 91 and three inductors (L4=1 nH, L5=2 nH, and L6=3 nH), and a specific connection manner is shown in FIG. 18.

Figure 19:
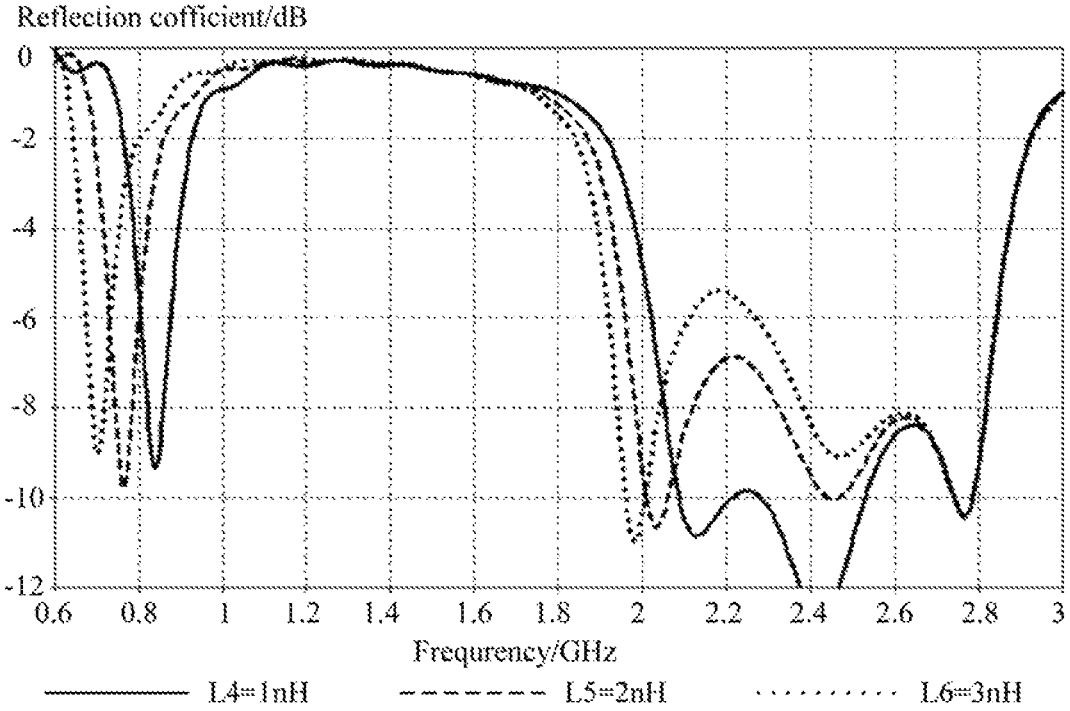
FIG. 19 is a curve chart of simulated reflection coefficients when the first adjustable unit and the second adjustable unit are used in the slot antenna according to Embodiment 2 of the present invention.

As shown in FIG. 19, FIG. 19 is a curve chart of simulated reflection coefficients obtained when setting of the first adjustable unit 4 switches to C2=0.9 pF, and the second adjustable unit 9 selects the inductor L4, the inductor L5, or the inductor L6 by using the switch apparatus. The horizontal axis represents frequency (Frequency, Freq for short), whose unit is Giga hertz (GHz), and the vertical axis represents reflection coefficient (reflection coefficient), whose unit is decibel (dB). A line is used to represent a curve chart of simulated reflection coefficients of the slot antenna when the switch apparatus in the second adjustable unit is connected to the inductor L4, a dashed line is used to represent a curve chart of simulated reflection coefficients of the slot antenna when the switch apparatus in the second adjustable unit is connected to the inductor L5, and a dotted line is used to represent a curve chart of simulated reflection coefficients of the slot antenna when the switch apparatus in the second adjustable unit is connected to the inductor L6. As can be seen from FIG. 19, when different inductance values are selected, antenna mode positions change, and a more diversified adjustment mechanism may be provided when two adjustable units are used at the same time than when only one adjustable unit is used, so as to help antenna engineers perform design according to different antenna requirements.

It should be noted that, in this embodiment of the present invention, resonance frequencies generated by the slot antenna are generated by the slot and are determined according to a length of the slot. Therefore, to ensure that the slot antenna can have good antenna property in a low frequency mode, the feeding end is disposed in an area near the middle line of the short side of the mobile phone. In addition, the first adjustable unit 4, the second adjustable unit 9, and the matching circuit 7 are merely one implementation manner listed in the embodiments of the present invention. Another connection manner of inductors and capacitors of the first adjustable unit 4, the second adjustable unit 9, and the matching circuit 7 also falls within the protection scope of the embodiments of the present invention.

This embodiment of the present invention provides the slot antenna. The slot antenna includes a system circuit board, a grounding conductor, a radiator, and a first adjustable unit. The system circuit board is connected to the grounding conductor to form an electric conductor, and the radiator is opposite to the electric conductor to form a slot. A feeding end is disposed on the system circuit board, the feeding end is electrically connected to the radiator, one end of the first adjustable unit is connected to the system circuit board, the other end of the first adjustable unit is connected to the radiator, and the first adjustable unit is configured to adjust a resonance frequency of the slot antenna. In the slot antenna provided in this embodiment of the present invention, the resonance frequency of the slot antenna is adjusted by using the first adjustable unit, so that the slot antenna can generate different slot-type resonance frequencies, to cover required bands.

Embodiment 3

Figure 20:
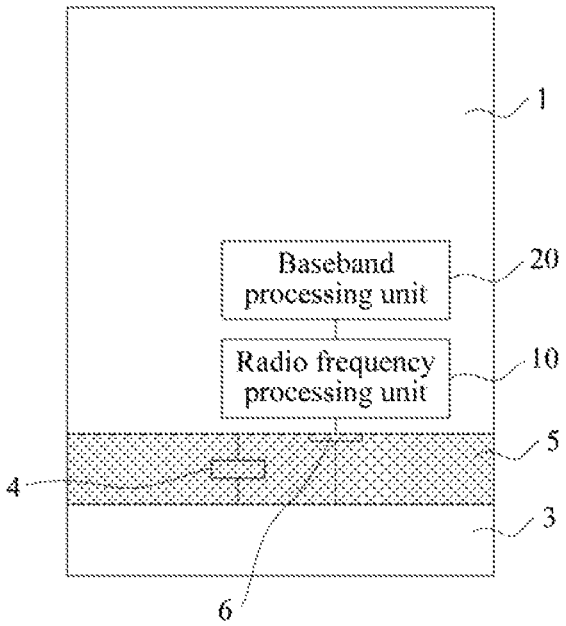
FIG. 20 is a schematic diagram of a mobile terminal according to Embodiment 3 of the present invention.

This embodiment of the present invention provides a mobile terminal. As shown in FIG. 20, the mobile terminal includes a radio frequency processing unit, a baseband processing unit, and the slot antenna described in Embodiment 1 or Embodiment 2. For details, refer to the slot antennas described in Embodiment 1 and Embodiment 2, and details are not described herein again.

The radio frequency processing unit 10 is electrically connected to the feeding end 6 of the system circuit board 1. The slot antenna is configured to: transmit a received radio signal to the radio frequency processing unit 10, or convert a transmitted signal of the radio frequency processing unit 10 into an electromagnetic wave and send the electromagnetic wave. The radio frequency processing unit 10 is configured to: perform frequency selection, amplification, and down-conversion processing on the radio signal received by the slot antenna, convert the radio signal into an intermediate frequency signal or a baseband signal, and send the intermediate frequency signal or baseband signal to the baseband processing unit 20, or configured to: perform up-conversion and amplification on a baseband signal or an intermediate frequency signal sent by the baseband processing unit 20 and send a radio signal by using the slot antenna. The baseband processing unit 20 processes the received intermediate frequency signal or baseband signal.

The mobile terminal may be a communications device that is used during movement, may be a mobile phone, or may be a tablet computer, a data card, or the like. Certainly, and the mobile terminal is not limited thereto.

This embodiment of the present invention provides the mobile terminal. The mobile terminal includes a radio frequency processing unit, a baseband processing unit, and a slot antenna. The slot antenna includes a system circuit board, a grounding conductor, a radiator, and a first adjustable unit. The system circuit board is connected to the grounding conductor to form an electric conductor, and the radiator is opposite to the electric conductor to form a slot. A feeding end is disposed on the system circuit board, the feeding end is electrically connected to the radiator, one end of the first adjustable unit is connected to the system circuit board, the other end of the first adjustable unit is connected to the radiator, and the first adjustable unit is configured to adjust a resonance frequency of the slot antenna. In the slot antenna provided in this embodiment of the present invention, the resonance frequency of the slot antenna is adjusted by using the first adjustable unit, so that the slot antenna can generate different slot-type resonance frequencies, to cover required bands.

Finally, it should be noted that the foregoing embodiments are merely intended for describing the technical solutions of the present invention other than limiting the present invention. Although the present invention is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of the present invention.

What is claimed is:

1. A mobile terminal, comprising:

a system circuit board;

a first grounding conductor;

a radiator;

a first adjusting circuit, wherein a first end of the first adjusting circuit is connected to the system circuit board and a second end of the first adjusting circuit is connected to the radiator, and the first adjusting circuit is configured to adjust a resonance frequency of the radiator, wherein the system circuit board is connected to the first grounding conductor to form an electric conductor, and the radiator is opposite to the electric conductor across a slot;

a feeding end disposed on the system circuit board, wherein the feeding end is electrically connected to the radiator, wherein the first adjusting circuit is disposed on a first side of the feeding end;

a first plurality of second grounding conductors, wherein the first plurality of second grounding conductors, the feeding end, and the first adjusting circuit are disposed on a first side of the system circuit board that faces the radiator, the first plurality of second grounding conductors are disposed on a first side of the first adjusting circuit and the first side of the feeding end, and the first plurality of second grounding conductors electrically connect the system circuit board to the first grounding conductor;

a second plurality of second grounding conductors, wherein the second plurality of second grounding conductors are disposed on the first side of the system circuit board that faces the radiator, and disposed on a second side of the first adjusting circuit and a second side of the feeding end, the second side of the feeding end is opposite to the first side of the feeding end, and wherein the second plurality of second grounding conductors electrically connect the system circuit board to the first grounding conductor;

a second adjusting circuit, wherein a first end of the second adjusting circuit is electrically connected to the system circuit board, and a second end of the second adjusting circuit is electrically connected to the radiator, and the second adjusting circuit is disposed on the second side of the feeding end; and a first matching circuit disposed between the first adjusting circuit and the second adjusting circuit, and disposed on the first side of the system circuit board facing the radiator.

2. The mobile terminal according to claim 1, wherein no grounding conductors are disposed between the first adjusting circuit and the feeding end.

3. The mobile terminal according claim 1, wherein the first adjusting circuit comprises a switch and at least two reactive circuit elements, the at least two reactive circuit elements are connected in parallel to form a parallel circuit, a first end of the switch is connected to the system circuit board, a control end of the switch is configured to receive a switching signal, a second end of the switch is configured to connect to one reactive circuit element in the parallel circuit at one end of the parallel circuit according to the switching signal, and another end of the parallel circuit is connected to the radiator.

4. The mobile terminal according to claim 3, wherein the first adjusting circuit further comprises a variable capacitor having one end connected to the system circuit board, and another end connected to the first end of the switch.

5. The mobile terminal according to claim 1, wherein the second adjusting circuit comprises a switch and at least two reactive circuit elements, the at least two reactive circuit elements are connected in parallel to form a parallel circuit, a first end of the switch is connected to the system circuit board, a control end of the switch is configured to receive a switching signal, a second end of the switch is configured to connect to one reactive circuit element in the parallel circuit at one end of the parallel circuit according to the switching signal, and another end of the parallel circuit is connected to the radiator.

6. The mobile terminal according to claim 5, wherein the second adjusting circuit further comprises a variable capacitor having one end connected to the system circuit board, and another end connected to the first end of the switch.

7. The mobile terminal according to claim 1, wherein the slot formed by the radiator and the electric conductor is of a flat shape.

8. The mobile terminal according to claim 1, wherein the slot formed by the radiator and the electric conductor is of a bent shape.

9. The mobile terminal according to claim 1, wherein the slot formed by the radiator and the electric conductor includes at least two bends.

10. The mobile terminal according to claim 1, further comprising:

a radio frequency processor electrically connected to the feeding end on the system circuit board; and a baseband processor, wherein:

the radiator is configured to:

transmit a received radio signal to the radio frequency processor; or convert a transmitted signal of the radio frequency processor into an electromagnetic wave and send the electromagnetic wave;

the radio frequency processor is configured to:

perform frequency selection, amplification, and down-conversion processing on the radio signal received by the radiator, convert the radio signal into an intermediate frequency signal or a baseband signal, and send the intermediate frequency signal or baseband signal to the baseband processor; or perform up-conversion and amplification on a baseband signal or an intermediate frequency signal sent by the baseband processor, and send a radio signal by using the radiator; and the baseband processor is configured to process the received intermediate frequency signal or baseband signal.

11. The mobile terminal according to claim 1, wherein:

the first adjusting circuit and second adjusting circuit are disposed on the first side of the system circuit board that faces the radiator.

12. A mobile terminal, comprising:

a system circuit board;

a first grounding conductor;

a radiator;

a first adjusting circuit, wherein a first end of the first adjusting circuit is connected to the system circuit board and a second end of the first adjusting circuit is connected to the radiator, and the first adjusting circuit is configured to adjust a resonance frequency of the radiator, wherein the system circuit board is connected to the first grounding conductor to form an electric conductor, and the radiator is opposite to the electric conductor across a slot;

a feeding end disposed on the system circuit board, wherein the feeding end is electrically connected to the radiator, wherein the first adjusting circuit is disposed on a first side of the feeding end;

a first plurality of second grounding conductors, wherein the first plurality of second grounding conductors, the feeding end, and the first adjusting circuit are disposed on a first side of the system circuit board that faces the radiator, the first plurality of second grounding conductors are disposed on a first side of the first adjustable circuit and the first side of the feeding end, and the first plurality of second grounding conductors electrically connect the system circuit board to the first grounding conductor;

a second plurality of second grounding conductors, wherein the second plurality of second grounding conductors are disposed on the first side of the system circuit board that faces the radiator, and disposed on a second side of the first adjusting circuit and a second side of the feeding end, the second side of the feeding end is opposite to the first side of the feeding end, and wherein the second plurality of second grounding conductors electrically connect the system circuit board to the first grounding conductor;

a second adjusting circuit, wherein a first end of the second adjusting circuit is electrically connected to the system circuit board, and a second end of the second adjusting circuit is electrically connected to the radiator, and the second adjusting circuit is disposed on the second side of the feeding end; and a first matching circuit disposed between the first adjusting circuit and the second adjusting circuit, and disposed on the first side of the system circuit board facing the radiator, and wherein the first matching circuit comprises:

a first capacitor having one end connected to the radiator, a first inductor having one end connected to the feeding end of the system circuit board and another end connected to another end of the first capacitor, and a second capacitor having one end connected to the one end of the first inductor and another end grounded.

13. The mobile terminal according to claim 12, wherein the first adjusting circuit includes:

a parallel circuit having one end connected to the radiator, the parallel circuit including a second inductor, a third inductor, a third capacitor, and a fourth capacitor, in parallel with one another, and a switch having a first end connected to the system circuit board, a control end configured to receive a switching signal, and a second end connected to one of the second inductor, the third inductor, the third capacitor, and the fourth capacitor at another end of the parallel circuit, according to the switching signal received by the switch.

14. The mobile terminal according to claim 13, wherein the second adjusting circuit comprises:

another parallel circuit having one end connected to the radiator, the another parallel circuit including a plurality of inductors in parallel with one another, and another switch having a first end connected to the system circuit board, a control end configured to receive a switching signal, and a second end connected to one of the plurality of inductors at another end of the another parallel circuit, according to the switching signal received by the another switch, wherein the first adjusting circuit and the second adjusting circuit are disposed on the first side of the system circuit board that faces the radiator.

15. The mobile terminal according to claim 14, wherein no grounding conductors are disposed between the first adjusting circuit and the second adjusting circuit.

* * * * *